United States Patent [19]

Schmitt et al.

[11] Patent Number: 4,811,710

[45] Date of Patent: Mar. 14, 1989

[54] FUEL INJECTION PUMP FOR INTERNAL COMBUSTION ENGINES

[75] Inventors: Alfred Schmitt, Ditzingen; Gerhard Stumpp, Stuttgart; Dietrich Trachte, Leonberg; Wolf Wessel, Oberriexingen, all of Fed. Rep. of Germany

[73] Assignee: Robert Bosch GmbH, Stuttgart, Fed. Rep. of Germany

[21] Appl. No.: 220,278

[22] Filed: Jul. 18, 1988

[30] Foreign Application Priority Data

Jul. 29, 1987 [DE] Fed. Rep. of Germany ..... 3725088

[51] Int. Cl.[4] ..... F02M 39/00

[52] U.S. Cl. ..... 123/359; 123/198 DB; 123/387

[58] Field of Search ..... 123/498, 387, 385, 386, 123/198 DB, 198 D, 357, 358, 359

[56] References Cited

U.S. PATENT DOCUMENTS

| | | | |
|---|---|---|---|
| 2,902,019 | 9/1959 | Aldinger | 123/387 |
| 3,587,540 | 6/1971 | Hofman | 123/357 |
| 3,656,465 | 4/1972 | Frankle | 123/198 DB |
| 3,724,430 | 4/1973 | Adler | 123/357 |
| 3,841,291 | 10/1974 | Ludewig | 123/198 DB |
| 3,978,837 | 9/1976 | Lunberg | 123/357 |
| 4,019,448 | 4/1977 | Hobo et al. | 123/139 |
| 4,209,000 | 6/1980 | Ivie | 123/198 DB |
| 4,296,718 | 10/1981 | Baugh | 123/387 |
| 4,319,550 | 3/1982 | Ishii | 123/198 DB |
| 4,565,170 | 1/1986 | Grieshaber et al. | 123/359 |
| 4,680,711 | 7/1987 | Miyawaki | 123/198 DB |
| 4,741,306 | 5/1988 | Watanabe | 123/198 DB |

FOREIGN PATENT DOCUMENTS

| | | | |
|---|---|---|---|
| 3304335 | 8/1984 | Fed. Rep. of Germany | 123/359 |
| 2082346 | 12/1971 | France | 123/359 |
| 0047630 | 4/1981 | Japan | 123/359 |
| 1350406 | 4/1974 | United Kingdom | 123/359 |

*Primary Examiner*—Carl Stuart Miller
*Attorney, Agent, or Firm*—Edwin E. Greigg

[57] ABSTRACT

A fuel injection pump for internal combustion engines having a hydraulic control mechanism includes a control cylinder with a control piston actuating a control member, a hydraulic work chamber and one switching valve each for an input and an output controlled by a valve control unit. The inflow to and return from the work chamber is provided with the control valves in order to shut down the engine upon a shutoff or a malfunction in the hydraulic control mechanism. The fuel feed pump is electrically driven, and the hydraulic work chamber communicates with the fuel tank via a relief device. The supply of current to the valve control unit and the feed pump is switched on and off, along with the rest of the current supply to the engine, via a driving switch. Additionally, the valve control unit is embodied such that upon the appearance of a persistent control deviation of the control member, the valve control unit shuts off the feed pump. The relief device includes various variant embodiments operative upon shutoff of the current supply or the occurrence of a malfunction and enables the restoration of the control mechanism to its zero or stopping position.

25 Claims, 5 Drawing Sheets

FUEL INJECTION PUMP FOR INTERNAL COMBUSTION ENGINES

BACKGROUND OF THE INVENTION

The invention is directed to improvements in fuel injection pumps for internal combustion engines, in particular an in-line injection pump for Diesel engines.

In a known fuel injection pump of this type having a hydraulic control mechanism (French patent No. 2 082 346), the control element that specifies the pump fuel injection rate is adjusted by an amount calculated by the control unit, as a function of engine operating parameters, so that the injection rate is adjusted to an optimal value for the instantaneous operating state of the engine. To lengthen the adjusting travel of the control element, the inlet switching valve disposed in the inlet to the control mechanism is opened, preferably in clocked fashion, and to shorten the control path, the return switching valve disposed in the return from the control mechanism to the fuel tank is opened, preferably intermittently, while the inlet switching valve is closed. The pressure in the control chamber is thus raised or lowered, and as a result the control piston is extended farther, counter to the force of the restoring spring, or retracted again. The suction chamber of the fuel injection pump, from which the quantity of fuel to be injected is drawn in the intake stroke of the pump piston, is filled with fuel continuously by a fuel feed pump driven in common with the pump piston. The suction chamber communicates via an overflow valve with the fuel tank, so that when the fuel feed pump is pumping continuously, a constant pressure is maintained in the suction chamber.

From German Offenlegungsschrift No. 33 04 335, a fuel injection pump having an electrohydraulic injection pump governor is known, which in addition to or instead of the feed pump driven in common with the pump piston has a separately driven electric feed pump. For rapid shutdown of the engine, upon the occurrence of a lasting control deviation at the control member, the feed direction of the fuel feed pump is reversed by reversing the polarity of the reversible drive motor, thereby partly emptying the suction chamber. The pump piston of the fuel injection pump cannot aspirate any more fuel from the suction chamber, and the engine comes to a stop.

OBJECT AND SUMMARY OF THE INVENTION

It is an object of the fuel injection pump according to the invention to provide an advantage that when the engine ignition is shut off and hence the supply of current is shut off as well, the engine is shut down relatively quickly, because on the one hand the supply of fuel to the suction chamber is stopped and on the other the hydraulic control mechanism is returned to its zero and stopping position. The electrical and constructional provisions required for this are relatively simple, so that the fuel injection pump does not become markedly more expensive. The relief device may be embodied by electromechanical, hydromechanical or simply mechanical components. Filling of the suction chamber is disrupted by shutting off the feed pump. Subsequent intake strokes of the pump piston of the fuel injection pump that continue to occur empty the suction chamber, so that the engine comes to a stop with a delay, as soon as a partial vacuum of approximately 0.3 bar of absolute pressure is attained.

A check valve between the feed pump and the fuel reservoir of the hydraulic control mechanism prevents fuel from the reservoir from being fed into the suction chamber when the feed pump is stopped, which would make the engine take longer to come to a stop.

It is more expensive in terms of circuitry to reverse the feed direction of the feed pump, rather than simply shutting it off, but it shortens the delay between the time the engine is shut off and when it actually stops, because the suction chamber of the fuel injection pump is emptied faster.

The relief device connected to the control chamber becomes operative in the shutoff situation and causes the pressure in the control chamber to drop, so that the control piston is returned, under the influence of the restoring spring and with the control member at the same time returned to its zero or stopping position, so that the injection quantity is reduced to zero.

For the shutoff situation, the relief device may be embodied as a locking circuit for maintaining the current supply at the control unit; this circuit is finally shut off when the control piston reaches the zero or stopping position and the injection quantity is hence at zero.

The relief device may also be embodied so as to be operative not only in the shutoff situation, but whenever the return switching valve is without current or in other words closed, on the condition that in addition, the fuel feed pump is always shut off whenever a lasting control deviation occurs in the control member. A control deviation of this kind can occur as a result of a current failure (switching valves constantly closed) or if the control member becomes stuck. In such malfunctions as well, the engine is brought to a stop, and the hydraulic control mechanism is shifted to its zero or stopping position.

In the simplest case, the relief device can be embodied as a throttle that bypasses the return switching valve. This throttle may be disposed in a bypass line, or be integrated with the return switching valve itself.

Providing the relief device as a non-return valve in a connecting line between the control chamber of the control mechanism and the fuel tank avoids leakage losses that arise with a throttle, and the fuel feed pump can be smaller. The non-return valve should be controlled such that it is always closed in normal operation but is opened in shutoff and malfunction situations. Various possible embodiments of such non-return valves are described hereinafter.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
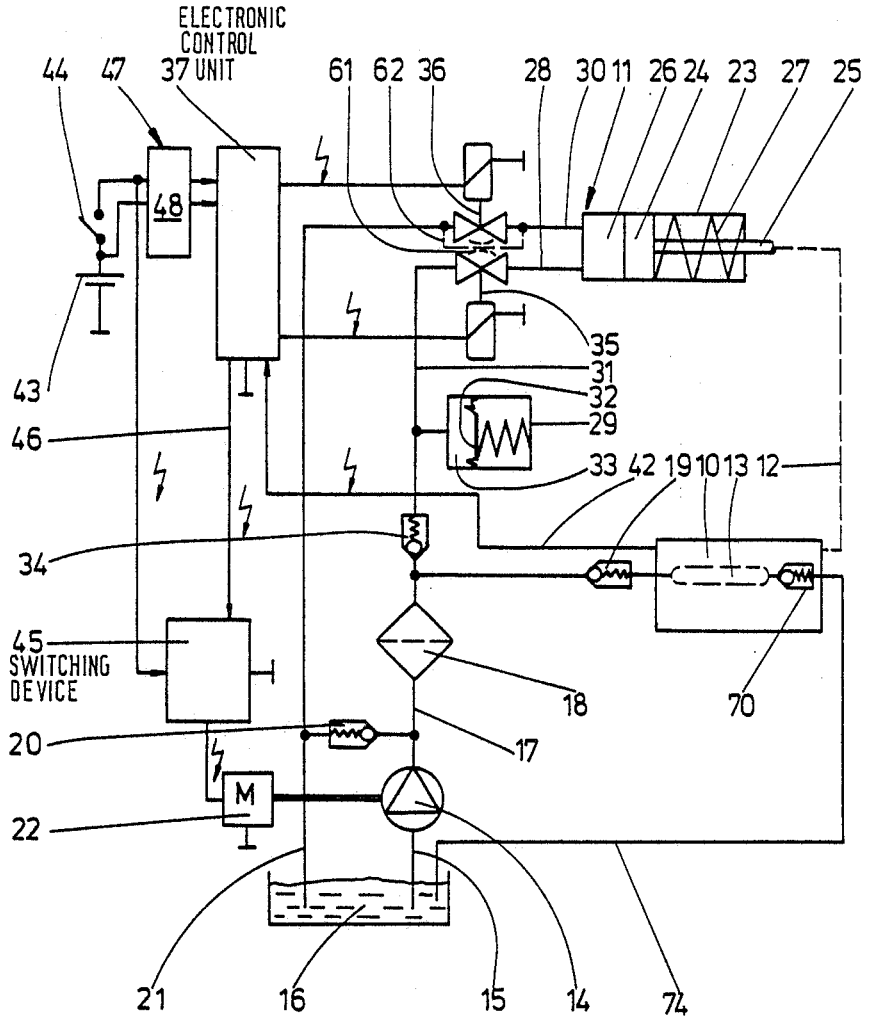
FIG. 1 is a block circuit diagram of a fuel injection pump in a first exemplary embodiment.

The first exemplary embodiment, shown schematically in FIG. 1, shows the circulation of fuel in a fuel injection pump 10 for a Diesel engine, and an associated hydraulic control mechanism 11 for actuating a governor rod 12, suggested by dot-dash lines, which in turn controls the fuel injection quantity metered by the fuel injection pump 10 per pump piston stroke. 13 indicates a suction chamber of the fuel injection pump 10, which is filled with fuel by a feed pump 14 and from which fuel is aspirated for injection upon each pump piston stroke. The suction chamber 13 is connected via a one-way overflow valve 70 to a return line 74 leading to a fuel tank 16, as a result of which the suction chamber pressure is kept at a constant value. The feed pump 14 is electrically driven and communicates on the intake side with the fuel tank 16 via a suction line 15 and on the compression side with the suction chamber 13 via a pressure line 17. Disposed in the pressure line 17 are a fuel filter 18 and a one-way check valve 19; the direction of flow through the one-way check valve 19 is toward the suction chamber 13 of the fuel injection pump 10. The pressure line 17 is also connected via a one-way check valve 20, having a blocking direction toward the pressure line, to a fuel return line 21. The feed pump 14 is driven by an electric motor 22.

The hydraulic control mechanism 11 has a control cylinder 23, in which a control piston 24 is axially displaceably guided. With one piston face, the control piston 24 engages the governor rod 12 by means of a coupling rod 25. The piston also defines a control chamber 26, and on its piston face remote from the control chamber 26, the piston is loaded by a restoring spring 27 supported in the control cylinder 23 which urges the control piston 24 in the direction of a minimal control chamber volume. The control chamber 26 communicates via an inlet 28 with a fuel reservoir 29 and via a return 30 with the fuel return line 21. The fuel reservoir 29 is connected via a second pressure line 31 to the outlet of the fuel filter 18, and has a spring-loaded diaphragm 32, which defines a reservoir chamber 33. Upon fuel feeding by the feed pump 14, the reservoir chamber 33 is filled with fuel, as the diaphragm 32 retracts, thus putting pressure on the fuel reservoir 29. A one-way check valve 34 is disposed between the fuel filter 18 and the fuel reservoir 29; the direction of flow through this check valve is toward the fuel reservoir 29.

Figure 2:
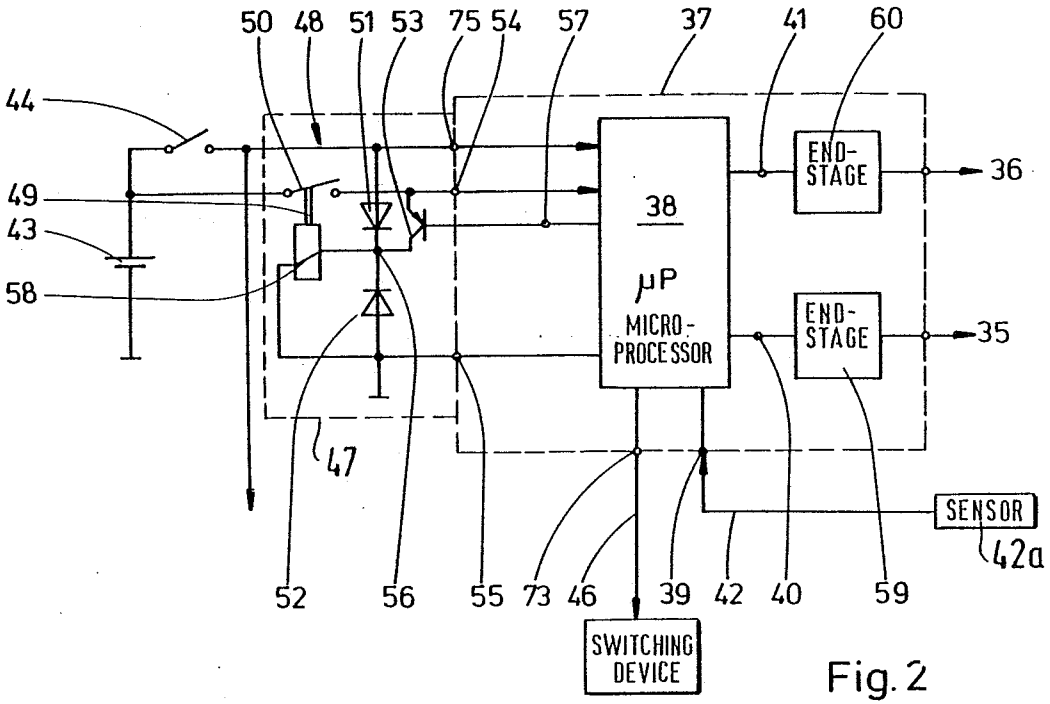
FIG. 2 is a circuit diagram of a control unit and a locking circuit for the fuel injection pump in FIG. 1.

Disposed in the inflow 28 to the control chamber 26 of the control mechanism 11 is a first switching valve 35, hereinafter the electro-magnetic inflow switching valve 35, and in the return 30 from the control chamber 26 to the fuel return line 21 a second electro-magnetic switching valve 36, hereinafter known as the return switching valve 36. Both switching valves 35, 36 are embodied as 2/2-way magnetic valves, the control inputs of which are connected to an electronic control unit 37. The electronic control unit 37, sketched in the block circuit diagram in FIG. 2, has a microprocessor 38 having an input 39 for an actual-value signal, dictating the injected fuel quantity, and two outputs 40, 41 for switching valve control signals, which via two end stages 59, 60 send exciter current signals to the exciter coils of the switching valves 35, 36. The microprocessor 38 calculates a set-point fuel injection quantity as a function of the instantaneous operating parameters of the Diesel engine and after comparison with the actual-value signal present at the input 39, generates switching signals for the two switching valves 35, 36. To this end, the input 39 is connected via a signal line 42 to a sensor 42*a*, which generates an electrical sensor signal corresponding to the actually injected fuel quantity. The actual position of the governor rod 12, for instance, may be sensed as the actual-value signal. The supply voltage for the electronic control unit 37 is picked up from a vehicle battery 43 and applied via the driving or ignition switch 44 to the electronic control unit 37. Via a further output 73, the microprocessor 38 is connected to a switching device 45 for the drive motor 22. A switching signal is present at this output whenever the governor rod 12 indicates a persistent control deviation, that is, whenever a difference btween the calculated set-point position of the governor rod 12 and the actual position is no longer controlled to zero. This switching signal passes via a signal line 46 to the switching device 45, where, depending upon the embodiment of the switching device 45, the switching signal effects either a shutoff of the electric motor 22, or a reversal of the polarity of the electric motor 22, so that the feed pump 14 reverses in its pumping direction, causing an ensuing shutoff of the drive motor 22, after an interval of time. The supply of current to the switching device 45 and from here for the electric motor 22 is again provided via the driving or ignition switch 44.

For shutoff of the Diesel engine 44, the driving or ignition switch 44 is opened. This shuts off the supply of current for the electric control unit 37 and the drive motor 22 of the feed pump 14. The feed pump 14 pumps no further fuel into the suction chamber 13, and once this chamber is largely emptied, by the pumping piston of the fuel injection pump, the engine stops. To return the control mechanism 11 to its zero or stopping position in the shutoff situation as well, a relief device 47 is disposed between the control switch 44 and the electronic control unit 37; in the shutoff situation, the relief device 47 supplies a current to the electromagnet of the switch 36 which opens switch 36 to connect the control chamber 26 with the fuel tank 16, relieving the control chamber 26 and causing the restoring spring 27 to press the control piston 24 back into its zero or stopping position, thereby expelling fuel from the control chamber 26; in this position, the volume of the control chamber is minimal, and the governor rod 12 assumes its "zero injection quantity" position.

In FIG. 1, the relief device 47 is embodied, using the return switching valve 36, by a so-called self-locking circuit 48, which keeps up the supply of current to the electric control unit 37 long enough, after the opening of the driving switch 44, for the governor rod 12 to reach its "zero injection quantity" position. By keeping up the current supply to the control unit 37, this unit is capable, in the shutoff situation, of generating an opening signal for the return switching valve 36, so the return switching valve 36 remains open after the opening of the ignition switch 44 long enough for all the fuel to drain out of the control chamber 26 into the fuel tank 16. The "zero injection quantity" position of the governor rod 12 is indicated by the actual-value signal present at the input 39 of the microprocessor 38, which at that time becomes zero. The self-locking circuit 48 is shown in the circuit diagram of FIG. 2. It includes a switching relay 49 having a switch contact 50 embodied as a closing means, a series circuit of two diodes 51 and 52 of opposite polarity, and a p-n-p transistor 53. Of the two inputs 54, 55 of the control unit 37 for the direct-current supply, the positive-potential input 54 is connected via the switching contact 50 of the switching relay 49 to the positive terminal of the battery 43, bypassing the driving switch 44. The output of the driving switch 44 is connected to a further input 75 of the control unit 37 and from there is likewise carried to the microprocessor 38. The series circuit of the diodes 51, 52 is connected to the input 75 and to the negative-potential input 55 of the control unit 37. The transistor 53 is connected between the connection point 56 of the two diodes 51, 52 and the positive-potential input 54 of the control unit 37. Its control input is connected to an output 57 of the microprocessor 38, at which an output signal that triggers the transistor 53 is present as long as the actual-value signal at the input 39 of the microprocessor 38 is greater than zero. The relay winding 58 of the switching relay 49 is connected to the connecting point 56 and to the zero-potential input 55 of the control unit 37.

The self-locking circuit 48 functions as follows:

When the driving switch 44 is actuated, the switching relay 49 is excited via the diode 51; the switch contact 50 closes, and the control unit is supplied with direct voltage. If the driving switch 44 is opened, for shutting off the engine, the supply of current to the relay winding 58 is maintained via the opened transistor 53. The shutoff situation is recognized by the microprocessor 38 by the falloff of the voltage at the input 75 of the control unit 37. The microprocessor 38 generates an opening signal, which via the output 41 and the end stage 50 opens the return switching valve 36. By the time the control mechanism 11 has attained its zero or stopping position, by means of the return of the control piston 24 to its stop position, on the left as seen in FIG. 1, the governor rod 12 has returned to its "zero injection quantity" position. The actual-value signal at the input 39 of the microprocessor 38 becomes zero, and the control signal at the output 57 of the microprocessor 38 vanishes. The transistor 53 thus prevents current flow; the excitation of the switching relay 49 ends; and the switch contract 50 opens. The supply of current to the control unit 37 is thus switched off. Upon the opening of the driving switch, as already mentioned, the drive motor 22 has been shut off and the feed pump 14 accordingly shut off. The engine comes to a stop, once the suction chamber 13 is partly emptied, after a few intake strokes of the pump piston of the fuel injection pump 10, and once the pressure in the suction chamber 13 has therefore dropped to approximately 0.3 bar of absolute pressure. The diode 52 serves as a recovery diode.

Instead of the self-locking circuit 48, which is somewhat expensive in terms of circuitry, a simple throttle 61 may be used as the relief device 47, which in the shutoff situation and with the immediate disappearance of the supply of current to the control unit 37 bypasses the return switching valve 36, which is closed when there is no current, and thus establishes communication between the control chamber 26 and the fuel return line 21. As shown in dashed lines in FIG. 1, this throttle 61 may be disposed in a bypass line 62 around the return switching valve 36; however, it may also be integrated with the return switching valve 36 itself. To this end, the valve seat of the return switching valve 36 may for example be embodied as a throttle that is operative in the closing state of the valve, which is readily done by providing a certain lack of tightness of the valve seat. The throttle 61, like the embodiments of the relief device 47 to be described below, has the advantage that not only in the shutoff situation but also in the event of a malfunction, it is always operative whenever the feed pump 14 is shut off and so assures a return of the control mechanism 11 to its zero or stopping position.

Figure 3:
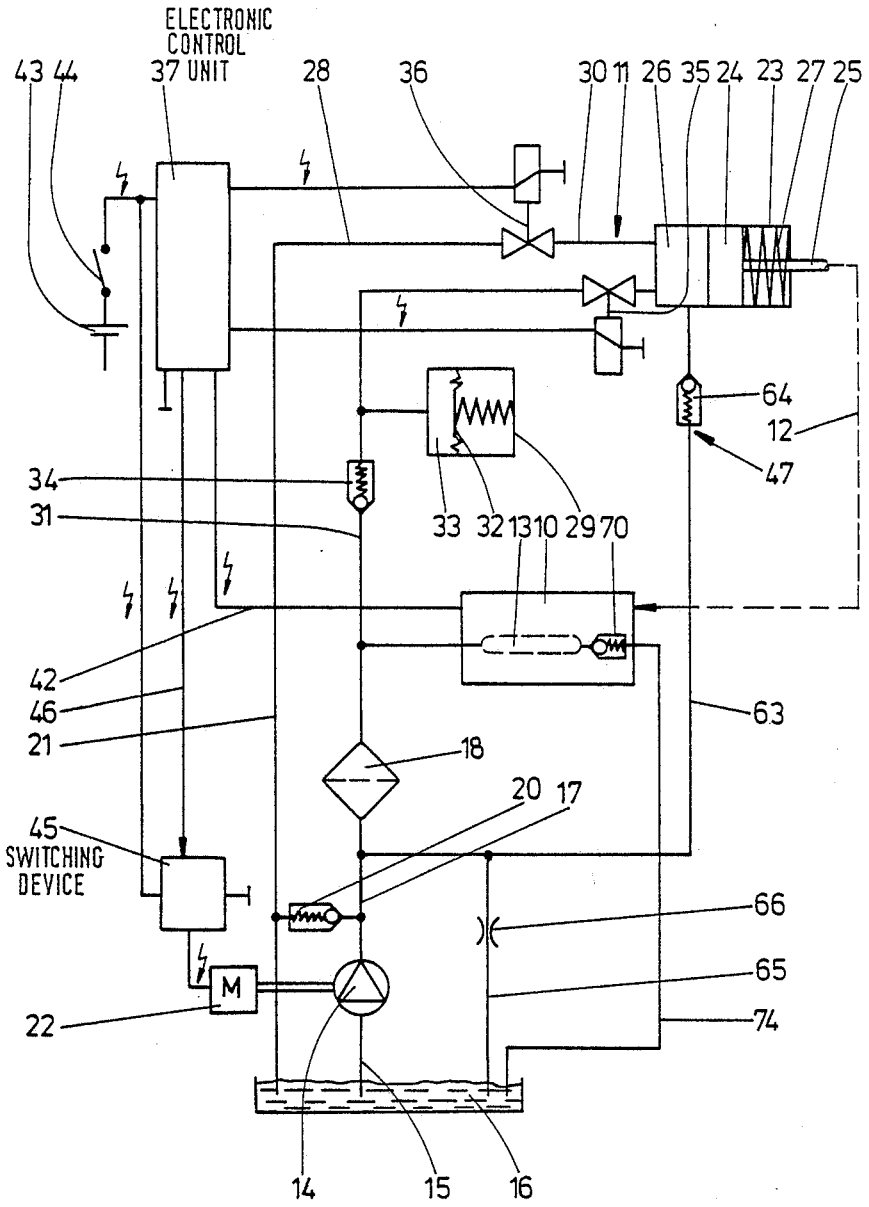
FIGS. 3–5 are respective block circuit diagrams for three different exemplary embodiments of a fuel injection pump.

The exemplary embodiment shown in FIG. 3 is largely like that of FIG. 1, and the same elements are identified by the same reference numerals. Only the relief device 47 is modified in FIG. 3, as compared with the relief device 47 of FIG. 1. Here the relief device comprises a connecting line 63, connected between the control chamber 26 and the pressure-side outlet of the feed pump 14, in which is disposed a non-return one-way valve 64 in the form of a flutter valve or check valve having a bias of approximately 0.5 bar. The non-return direction of the non-return valve 64 is toward the control chamber 26 of the control cylinder 23. The switching device 45 for the feed pump 14 is embodied such that in the shutoff situation, or opening of the driving switch 44, as well as in a malfunction, i.e., upon a persistent control deviation caused by sticking of the governor rod 12 or jamming of the inflow and/or return switching valve 35 or 36, the feed pump 14 briefly reverses its pumping direction and then is shut off. If the switching device 45 is designed such that in the situations mentioned only the feed pump 14 is shut off, then the relief device 47 also includes a bypass 65 between the pressure side of the feed pump and the fuel tank 16, in which a bypass throttle 66 is disposed. During the operation of the fuel injection pump 10, the feed pressure of the feed pump 14 locks the non-return valve 64, so that the control chamber 26 is closed and no fuel can drain out via the non-return valve 64. If the feed pump 14 is shut down, then the connecting line 63 empties via the bypass throttle 66. If there is no bypass 65, the reversal of the feed direction of the feed pump 14 once again effects the emptying of the connecting line 63. The non-return valve 64 thus opens, and fuel can drain from the control chamber 26, until the control piston 24 has attained its zero or stopping position.

In the third exemplary embodiment shown by FIG. 4, once again only the relief device 47 has been modified. All the other components match those of FIGS. 1 and 3, so that they are identified by the same reference numerals. The relief device 47 here is embodied as a hydraulically controllable switching valve 67, which is disposed in a bypass line 68 around the return switching valve 36. The switching valve 67, shown schematically in FIG. 4 with a hydraulically actuated displacement piston 69, is preferably a 2/2-way valve embodied as a slide valve. The switching valve 67 is embodied such that in its basic position, that is without action upon its hydraulic control chamber, it is in its open position and uncovers the bypass line 68. The hydraulic control input of the switching valve 67 is connected to the suction chamber 13 of the fuel injection pump 10. During operation of the fuel injection pump 10, the suction chamber 13 is filled with fuel. The suction chamber pressure is kept to a constant value in the usual manner via an overflow valve 70. Via a connecting line 71 between the suction chamber 13 and the control input of the switching valve 67, this suction chamber pressure also acts upon the displacement piston 69 of the switching valve 67, which closes, blocking the bypass line 68. In the shutoff situation or in the event of a malfunction (persistent control deviation of the governor rod 12) the feed pump 14 is shut off via the switching device 45, as described above. The suction chamber 13 of the fuel injection pump is emptied by means of repeated aspiration of fuel by the pump piston. The suction chamber pressure drops, and the switching valve 67 opens. This establishes a connection via the bypass line 68 between the control chamber 26 and the fuel return line 21, and the control piston 24 that is displaced under the influence of the restoring spring 27 expels the fuel out of the control chamber 26 into the fuel tank 16. The governor rod 12 is returned to its zero or stopping position. The engine is shut down. The shutdown of the engine is accelerated, if in the shutoff or malfunction situation the feed pump 14, prior to shutoff, is briefly operated with a reversed pumping direction.

Figure 5:
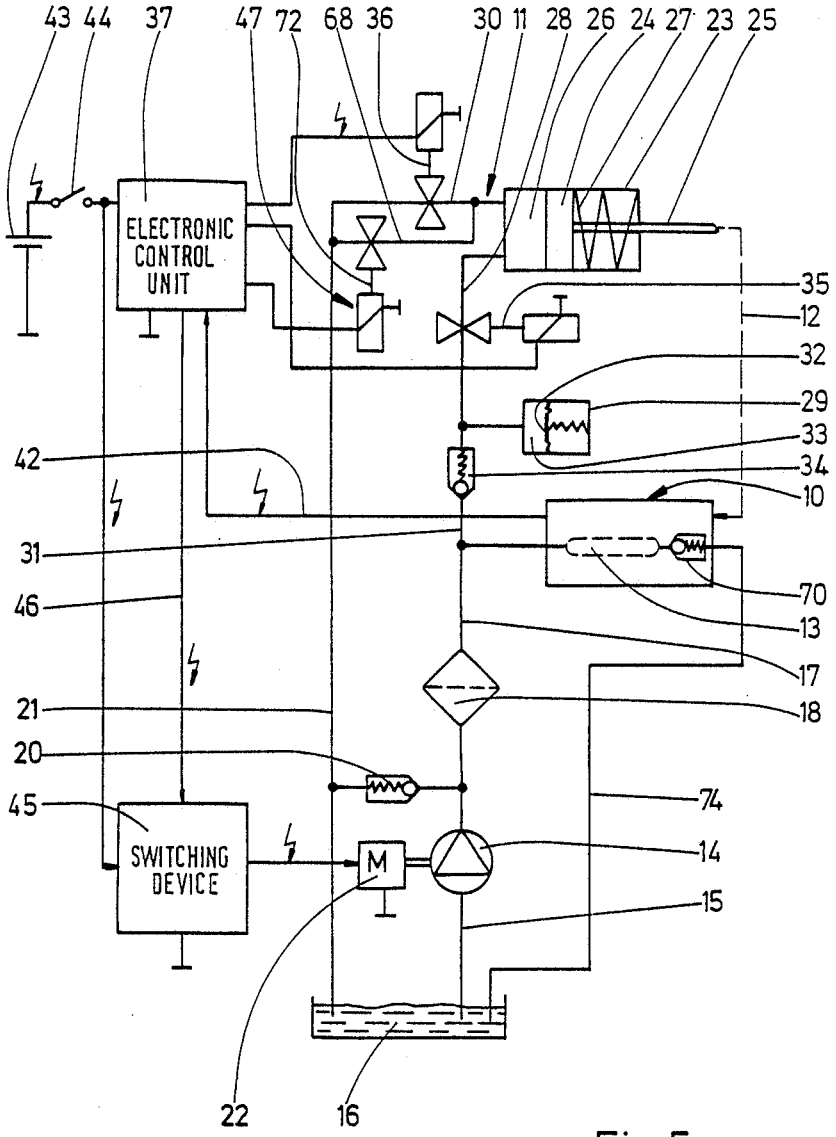

In the exemplary embodiment shown by FIG. 5, only the relief device 47 has been modified. Components matching those of the other embodiments are again identified by the same reference numerals. The relief device 47 here has an electrically controllable switching valve 72, which is opened when in its basic position without electric current. The switching valve 72 is preferably embodied as a 2/2-way magnetic valve and is connected with its electrical control input to the electronic control unit 37. The switching valve 72 is again disposed in a bypass line 68 around the return switching valve 36. The switching valve 72 is now triggered by the electronic control unit 37 such that when the current supply is applied to the electronic control unit 37, the switching valve 72 receives current, from the closure of the driving switch 44, and thereby blocks the bypass line 68. If the supply of current is shut off again by the opening of the driving switch, then the switching valve 72 receives no current and establishes the communication between the control chamber 26 and the fuel tank 16. A persistent control deviation of the governor rod 12, that leds to the generation of a shut-off signal for the switching device 45 of the feed pump 14 by means of the electric control unit 37, is also utilized for shutting off the current to the switching valve 72, so that even in the event of a malfunction, with the attendant shutoff of the feed pump 14, the switching valve 72 is opened.

Figure 4:
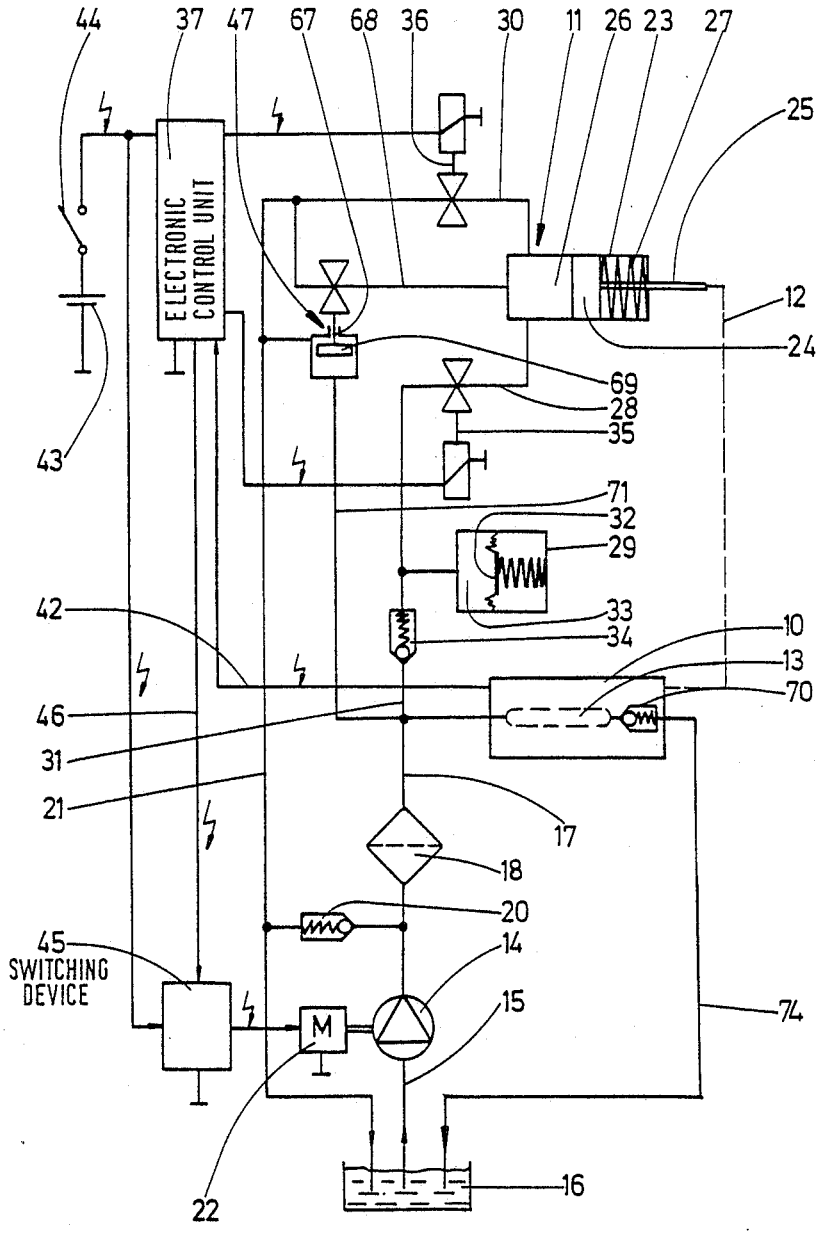

If the opening cross section of the valve openings of the switching valves 67 and 72 in the exemplary embodiments of FIGS. 4 and 5 is made larger than the opening cross section of the inflow switching valve 35, then even if the inflow switching valve 35 should stick in its open position, a shift of the control mechanism 11 to its zero or stopping position is attained, because upon the opening of the switching valves 67 and 72, the fuel can drain out of the control chamber 26 to the fuel tank 16 faster than it is being replenished from the fuel reservoir 29 into the control chamber 26.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, in particular an in-line injection pump for diesel engines, comprising a hydraulic control mechanism for actuating a governor rod that controls the injection quantity, said hydraulic control mechanism including a control cylinder, a control piston displaceable in said control cylinder, said control piston defining a control chamber therewithin, a restoring spring disposed in said control mechanism adapted to force said control piston in a displacement direction reducing a control chamber volume, first and second electric switching valves controllable by an electronic valve control unit, said first and second electric switching valves being closed if without current supply, one of said switching valves being disposed in an inflow line communicating with a pressurized fuel reservoir connected to said control chamber and the other of said switching valves being disposed in a return line leading from said control chamber to communicate with a fuel tank, a fuel pump suction chamber, a fuel feed pump connected to said fuel tank for filling said fuel pump suction chamber with fuel, said pressurized fuel reservoir (29) being connected via a pressure line (31) to a pressure-side outlet of said feed pump (14), said feed pump (14) being driven electrically by a feed pump drive motor, switch means being provided for controlling a current supply for said valve control unit (37) and for said feed pump drive motor, said switch means operating synchronously with an arbitrarily actuatable switch (44) for switching the engine on and off, said control chamber (26) of said control mechanism (11) being arranged to communicate with said fuel tank (16) via a relief control device (47) operative at least upon an actuation of said actuatable switch (44) to effect a shutoff of said engine.

2. An injection pump as defined by claim 1, in which said relief device (47) includes a self-locking electric circuit (48), provided to maintain a current supply for said valve control unit (37) subsequent to actuation of the switch (44) effecting a shutoff of the engine, effecting said valve control unit (37) having a control and computation unit, preferably embodied as a microprocessor (38), said microprocessor having as an input (39) an actual-value signal indicating an injected fuel quantity and two outputs (40, 41) for directing switching valve control signals to said first and second switching valves, said switching valve control signals being generated as a function of a set-point fuel injection quantity, calculated based on engine operating parameters, and an actual-value signal; and said control and computation unit (38) applies a shutoff signal to said self-locking circuit (48) whenever said actual-value signal becomes zero.

3. An injection pump as defined by claim 2, in which said self-locking circuit (48) includes a switch relay (49) having a switch contact (50) embodied as a closing means and a relay winding (58), a series circuit of two diodes (51, 52) of opposite polarity, and a transistor (53); said control unit (37) having two inputs (54, 55) for supplying a direct current, one of said two inputs being a positive-potential input (54) of said control unit (37) connected via a switch contact (50) of said switch relay (49) to a positive terminal of a battery (43); said series circuit of said two diodes (51, 52) being connected with said one and off switch (44) to effect a switching on and off of said engine and being further connected to ground; said relay winding (58) being connected to a diode connection point (56) and to ground, said transistor (53) being connected to the positive-potential input (54) of the control unit (36) and to the diode connection point (56); said control input of said transistor (53) being connected to an output (57) of said control and computation unit (38), which an output signal for triggering said transistor (53) is present as long as the actual-value signal at the input (39) of the control and computation unit (38) is greater than zero.

4. An injection pump as defined by claim 1, in which a switching device (45) responds to a persistent control deviation of said control member (12) provided for said feed pump (14) and upon an appearance of a control deviation shuts off said feed pump (14) after an expiration of an interval of time with a prior reversal of the pumping direction of the pump, said relief device (47) being operative upon a disappearance of a feed pressure of said feed pump (14).

5. An injection pump as defined by claim 1, in which said relief device (47) comprises a throttle (61) disposed in a bypass line (62) between said control chamber (26) of said control mechanism 11 and said fuel tank (16).

6. An injection pump as defined by claim 4, in which said relief device (47) comprises a throttle (61) disposed in a bypass line (62) between said control chamber (26) of said control mechanism 11 and said fuel tank (16).

7. An injection pump as defined by claim 1, in which said relief device (47) comprises a throttle integrated with said return switching valve (36).

8. An injection pump as defined by claim 4, in which said relief device (47) comprises a throttle integrated with said return switching valve (36).

9. An injection pump as defined by claim 7, in which said return switching valve (36) includes a valve seat embodied as a throttle that is operative in a closing state.

10. An injection pump as defined by claim 8, in which said return switching valve (36) includes a valve seat embodied as a throttle that is operative in a closing state.

11. An injection pump as defined by claim 1, in which said relief device (47) has a connecting line (63) connected between said control chamber (26) of the control cylinder (23) and a pressure-side outlet of said feed pump (14), a non-return valve (64) being disposed in said connecting line (63) a non-return direction of which is oriented toward said control chamber (26) and an opening direction of which is blockable by a feed pressure of said feed pump (14).

12. An injection pump as defined by claim 4, in which said relief device (47) has a connecting line (63) connected between said control chamber (26) of the control cylinder (23) and a pressure-side outlet of said feed pump (14), a non-return valve (64) being disposed in said connecting line (63) a non-return direction of which is toward said control chamber (26) and an opening direction of which is blockable by a feed pressure of said feed pump (14).

13. An injection pump as defined by claim 11, which includes a bypass (65) having a throttle (66) disposed therein connected between the pressure-side outlet of said feed pump (14) and said fuel tank (16).

14. An injection pump as defined by claim 12, which includes a bypass (65) having a throttle (66) disposed therein connected between the pressure-side outlet of said feed pump (14) and said fuel tank (16).

15. An injection pump as defined by claim 8, in which said non-return valve (64) comprises a flutter valve.

16. An injection pump as defined by claim 14, in which said non-return valve (64) comprises a flutter valve.

17. An injection pump as defined by claim 1, in which said relief device (47) includes a hydraulically controllable switching valve (67) that is open in an absence of control pressure, said switching valve (67) being incorporated with its valve connections in a bypass line (68) disposed around said return switching valve (36), and being connected with its control connection to said pump suction chamber (13) that communicates via a pressure line (17) with said feed pump (14).

18. An injection pump as defined by claim 4, in which said relief device (47) includes a hydraulically controllable switching valve (67) that is open in an absence of control pressure, said switching valve (67) being incorporated with its valve connections in a bypass line (68) disposed around said return switching valve (36), and being connected with its control connection to said pump suction chamber (13) that communicates via a pressure line (17) with said feed pump (14).

19. An injection pump as defined by claim 1, in which said relief device (47) has an electrically controllable switching valve (72) that is open in the absence of current and is incorporated with a valve connections in a bypass line (68) around said return switching valve (36), and that said switching valve (72) is controlled by said valve control unit (37) such that it is supplied with current for the duration of the switched-on current supply.

20. An injection pump as defined by claim 4, in which said valve control unit (37) is comprised such that it interrupts a supply of current to said switching valve (72) upon a persistent control deviation of said control member (12).

21. An injection pump as defined by claim 19, in which said valve control unit (37) is comprised such that it interrupts a supply of current to said switching valve (72) upon a persistent control deviation of said control member (12).

22. An injection pump as defined by claim 17, in which said switching valve (67, 72) has an opening cross section that is larger than the opening cross section of said inflow switching valve (35).

23. An injection pump as defined by claim 1, in which said switching valves comprise 2/2-way switching valves.

24. An injection pump as defined by claim 1, in which a check valve (34) having a forward direction oriented toward said fuel reservoir (29) is incorporated into a pressure line (31) leading from said pressure-side outlet of the feed pump (14) to said fuel reservoir (29).

25. An injection pump as defined by claim 1, in which a check valve (29) having a forward direction oriented toward said pump suction chamber (13) is incorporated into a pressure line (17) leading from said pressure-side outlet of the feed pump (14) to said pump suction chamber (13).

* * * * *